US012114780B2

(12) United States Patent
Shan et al.

(10) Patent No.: US 12,114,780 B2
(45) Date of Patent: Oct. 15, 2024

(54) SINGLE-MOTOR ELECTRICALLY POWERED BED

(71) Applicant: Keeson Technology Corporation Limited, Zhejiang (CN)

(72) Inventors: Huafeng Shan, Zhejiang (CN); Jian Wang, Zhejiang (CN); Shaojun Li, Zhejiang (CN); Chuanxiang Ji, Zhejiang (CN); Xiaowen Lu, Zhejiang (CN)

(73) Assignee: Keeson Technology Corporation Limited, Jiaxing (CN)

( * ) Notice: Subject to any disclaimer, the term of this patent is extended or adjusted under 35 U.S.C. 154(b) by 279 days.

(21) Appl. No.: 17/628,213

(22) PCT Filed: Apr. 23, 2020

(86) PCT No.: PCT/CN2020/086445

§ 371 (c)(1),
(2) Date: Jan. 18, 2022

(87) PCT Pub. No.: WO2021/012733

PCT Pub. Date: Jan. 28, 2021

(65) Prior Publication Data

US 2022/0248864 A1 Aug. 11, 2022

(30) Foreign Application Priority Data

Jul. 25, 2019 (CN) ..... 201910677855.0

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 19/122; A47C 17/04; A47C 20/04; A47C 20/08
(Continued)

(56) References Cited

U.S. PATENT DOCUMENTS 7,522,062 B2 * 4/2009 Mossbeck ..... A61G 7/018 5/616
2004/0148704 A1 * 8/2004 Tekulve ..... A61G 7/015 5/618

(Continued)

FOREIGN PATENT DOCUMENTS

CN 207236519 * 4/2018 ..... A47C 17/04
CN 207236519 U 4/2018
CN 108720413 A 11/2018

OTHER PUBLICATIONS

International Search Report of PCT Patent Application No. PCT/CN2020/086445 issued on Jun. 30, 2020.

*Primary Examiner* — Justin C Mikowski
*Assistant Examiner* — Alison N Labarge

(57) ABSTRACT

A single-motor electrically powered bed includes: a bed board, a frame, a slide assembly, a first connecting-rod mechanism, and a drive assembly; the bed board includes: a first bed board and a second bed board, one end of the first bed board being hingedly connected to one end of the second bed board; the second bed board is slidably connected to the frame by means of the slide component, the two ends of the first connecting-rod mechanism are hingedly connected to the first bed board and the frame, respectively, and the first bed board can be raised and lowered by means of the drive assembly. The single-motor electrically powered bed needs only one drive assembly to drive all of the bed boards to move, adjust the position and height of the human body, and achieve the lifting and lowering function of the electrically powered bed.

7 Claims, 4 Drawing Sheets

(58) Field of Classification Search
USPC ..... 5/616
See application file for complete search history.

(56) References Cited

U.S. PATENT DOCUMENTS

2006/0026763 A1* 2/2006 Mossbeck ..... A47C 20/041 5/616
2009/0094748 A1* 4/2009 Long ..... A47C 20/041 5/613
2009/0211028 A1* 8/2009 Richmond ..... A47C 20/08 5/717
2010/0325800 A1* 12/2010 Huang ..... A47C 19/022 5/616
2011/0094032 A1* 4/2011 Shih ..... A47C 20/041 5/616
2012/0240337 A1* 9/2012 Shih ..... A61G 7/015 5/616
2014/0041121 A1* 2/2014 Shan ..... A47C 21/006 5/618
2015/0067965 A1* 3/2015 Xu ..... A61G 7/018 5/616
2015/0107024 A1* 4/2015 Xu ..... A47C 20/041 5/616
2015/0121623 A1* 5/2015 Huang ..... A61G 7/018 5/616
2016/0262548 A1* 9/2016 Broom ..... A47C 19/005
2016/0286970 A1* 10/2016 Robertson ..... A47C 20/04
2016/0331612 A1* 11/2016 Clenet ..... A47C 20/08
2017/0347806 A1* 12/2017 Shih ..... A47C 20/041
2017/0360209 A1* 12/2017 Zhou ..... A47C 20/041
2018/0098899 A1* 4/2018 Lo ..... A61G 7/018
2018/0103770 A1* 4/2018 Nava ..... A47C 19/02
2018/0125249 A1* 5/2018 Chung ..... A47C 19/021
2018/0235373 A1* 8/2018 Tsai ..... A47C 20/08
2018/0271297 A1* 9/2018 Dewert ..... A61G 7/018
2018/0338625 A1* 11/2018 Nava ..... A47C 19/021
2019/0021509 A1* 1/2019 Shan ..... A47C 20/041
2019/0059601 A1* 2/2019 Kramer ..... A47C 19/045
2019/0069683 A1* 3/2019 Gajjar ..... A47C 19/021
2019/0191890 A1* 6/2019 Huang ..... A47C 20/10
2019/0328143 A1* 10/2019 Choi ..... A47C 20/18
2019/0328593 A1* 10/2019 Choi ..... A61G 7/018
2020/0022504 A1* 1/2020 Zhang ..... A47C 20/041

* cited by examiner

SINGLE-MOTOR ELECTRICALLY POWERED BED

FIELD OF THE INVENTION

The present disclosure relates to the technical field of machinery, and in particular, to a single-motor electrically powered bed.

BACKGROUND OF THE INVENTION

At present, most electric beds have two basic functions, i.e., lifting and lowering of a back portion bed board and lifting and lowering of a foot portion bed board, so as to adjust a human body to a suitable curve, thereby relaxing the body and providing a comfortable feeling. It generally requires two separate driving means and a controlling system to control lifting and lowering of a first bed board and the foot portion bed board. Therefore, adding an entire set of electrical system will lead to a great increase in costs of a product, and the electric bed has a relatively high price compared with a conventional non-electric bed.

The disclosure is a single-motor electrically powered bed. The electrically powered bed only uses one driving means to control lifting and lowering of the back portion bed board and the foot portion bed board. During a process of lifting of the first bed board, the first bed board moves backwards, so that the human body is always close to a wall when lying on the bed and that a distance between the human body and an object such as a TV can be maintained. By realizing folding, transportation costs can be greatly reduced, and it is more convenient for the electrically powered bed to be delivered into houses.

SUMMARY OF THE INVENTION

The disclosure provides a single-motor electrically powered bed to solve the technical problem of how to realize using one driving assembly to drive a bed board to deform and move.

For this purpose, the disclosure provides a single-motor electrically powered bed. The single-motor electrically powered bed includes: a bed board, a frame, a sliding assembly, a first connecting-rod mechanism, and a driving means. The bed board includes a first bed board, a second bed board, a third bed board, a fourth bed board, and a fifth bed board. The first bed board, the second bed board, the third bed board, and the fourth bed board are successively pivotably connected to one another at junctions and are horizontally arranged on a top of the frame, and the fifth bed board is disposed on the top of the frame according to a sequence. The first bed board is rotatably connected to the frame by the first connecting-rod mechanism, and the driving assembly is able to drive the first bed board to rotate relative to the second bed board and the frame. The second bed board is able to slide horizontally relative to the frame by the sliding assembly, and the second bed board slides horizontally with rotating movement of the first bed board and drives the third bed board and the fourth bed board to move horizontally.

Further, the single-motor electrically powered bed further includes a second connecting-rod mechanism. The fourth bed board is rotatably connected to the frame by the second connecting-rod mechanism, and the fourth bed board is able to rotate relative to the third bed board and the frame.

Further, the single-motor electrically powered bed further includes a third connecting-rod mechanism. The fifth bed board is pivotably connected to the fourth bed board according to the sequence, and the fifth bed board is rotatably connected to the frame by the third connecting-rod mechanism.

Further, the frame further includes a front frame and a rear frame. Herein, the front frame and the rear frame are pivotably connected to each other; the first bed board and the second bed board are disposed on a top of the front frame, and the third bed board, the fourth bed board, and the fifth bed board are disposed on a top of the rear frame; the second bed board and the third bed board are pivotably connected to each other; an outer diameter of the front frame is less than an inner diameter of the rear frame, and the sliding assembly is disposed at an inner side of the front frame; and when the first bed board is in a horizontal position, a pivot between the front frame and the rear frame and a pivot between the second bed board and the third bed board are located at a same axis.

Further, the driving assembly includes a driving means, a first holder, and a second holder. Herein, one end of the second holder is fixed on a position in the middle of an edge of the first bed board, which is close to the second bed board, and the other end of the second holder is pivotably connected to one end of the driving means and is in fixed connection with one end of the first holder; the other end of the driving means is connected to an edge of the front frame, which is close to the rear frame; the other end of the first holder is in fixed connection with the first bed board; and the driving means moves in a straight line horizontally to drive the first bed board to rotate relative to the second bed board and the front frame.

Further, the sliding assembly includes a guiding rail, a pulley, and a sliding frame. Herein, the guiding rail is fixed on an inner side of the front frame; the pulley is pivotably connected to the sliding frame, and is able to slide in the guiding rail; and the sliding frame is fixed on a bottom surface of the second bed board.

Further, the single-motor electrically powered bed further includes a reinforcing plate and a connecting plate. Herein, the reinforcing plate is fixed on a bottom surface of the third bed board; an extending direction of the reinforcing plate and an extending direction of the sliding frame are located in a same straight line; and the reinforcing plate and the sliding frame are in removable fixed connection by the connecting plate.

Further, the front frame is provided, at one end which is far away from the rear frame, with bed leg mounting holes disposed symmetrically, and the rear frame is provided, at each corner, with a bed leg mounting hole.

Further, the second bed board and the third bed board are connected by a single-piece hinge base.

By means of the above technical solution, the electric bed only needs one driving assembly to drive a bed board to deform and move horizontally, so as to realize a function of the electric bed, and a folding function of the electric bed can be realized by dividing a frame in the middle.

BRIEF DESCRIPTION OF THE DRAWINGS

Other features, objectives, and advantages of the present disclosure will become more evident by reading the detailed description of non-limiting embodiments made with reference to the following accompanying drawings.

LIST OF REFERENCE NUMERALS

1—bed board, 11—first bed board, 12—second bed board, 13—third bed board, 14—fourth bed board, 15—fifth bed board, 2—frame, 21—front frame, 22—rear frame, 3—sliding assembly, 31—guiding rail, 32—pulley, 33—sliding frame, 4—first connecting-rod mechanism, 5—driving assembly, 51—driving means, 52—first holder, 53—second holder, 6—second connecting-rod mechanism, 7—third connecting-rod mechanism, 8—reinforcing plate, 9—connecting plate, 10—bed leg mounting hole, 101—single-piece hinge base.

DETAILED DESCRIPTION OF THE EMBODIMENTS

The present disclosure will be explained in detail with reference to the accompanying drawings.

Figure 1:
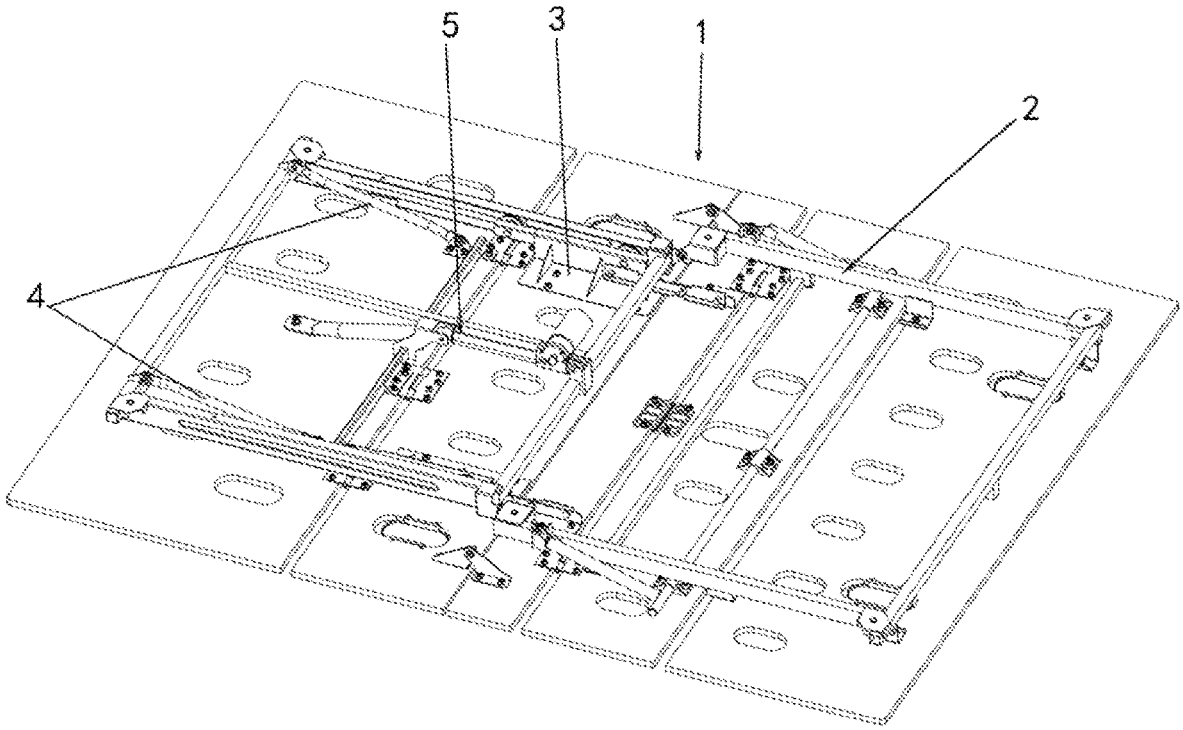
FIG. 1 schematically shows a single-motor electrically powered bed in a horizontally spreading state according to an embodiment of the disclosure.
Figure 2:
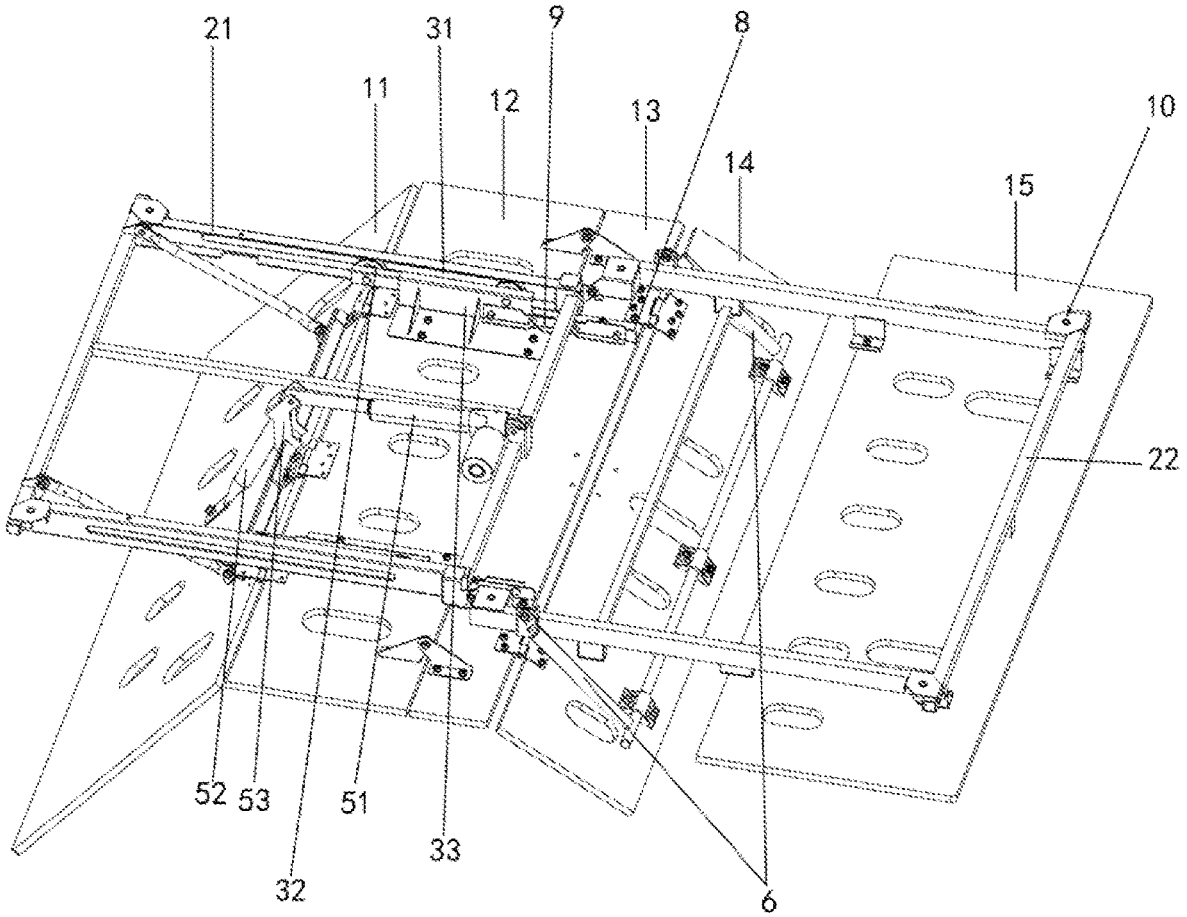
FIG. 2 schematically shows a single-motor electrically powered bed in a changing state according to an embodiment of the disclosure.

As shown in FIG. 1 and FIG. 2, a single-motor electrically powered bed provided in the disclosure includes a bed board 1, a frame 2, a sliding assembly 3, a first connecting-rod mechanism 4, and a driving assembly 5. Herein, the bed board 1 includes a first bed board 11, a second bed board 12, a third bed board 13, a fourth bed board 14, and a fifth bed board 15. The first bed board 11, the second bed board 12, the third bed board 13, and the fourth bed board 14 are successively pivotably connected to one another at junctions and are horizontally arranged on a top of the frame 2, and the fifth bed board 15 is disposed on the top of the frame according to a sequence. The first bed board 11 is rotatably connected to the frame 2 by the first connecting-rod mechanism 4, and the driving assembly 5 is able to drive the first bed board 11 to rotate relative to the second bed board 12 and the frame 2. The second bed board 12 is able to slide horizontally relative to the frame 2 by the sliding assembly 3, and the second bed board 12 slides horizontally with rotating movement of the first bed board 11 and drives the third bed board 13 and the fourth bed board 14 to move horizontally.

When the driving assembly 5 drives the first bed board 11 to rotate upwardly relative to the second bed board 12 and the frame 2, an angle between the first bed board 11 and the frame 2 increases, and a posture of a user gradually changes from a lying state to a semi-supine state or a sitting state. Meanwhile, under a limitation of the first connecting-rod mechanism 4, with increasing of the angle by which the first bed board 11 rotates upwardly, a horizontal distance between the first bed board 11 and the fifth bed board 15 also increases, and the first bed board 11 gradually moves closer to an end of the electrically powered bed. The first bed board 11, the second bed board 12, the third bed board 13, and the fourth bed board 14 are successively pivotably connected to one another at junctions. With cooperation of the sliding assembly 3, the first bed board 11 pulls the second bed board 12 to move horizontally and gradually move away from the fifth bed board 15, and the second bed board 12 pulls the third bed board 13 and the fourth bed board 14 to move horizontally towards the first bed board 11 and gradually move away from the fifth bed board 15. If the user leans on the first bed board 11 to watch TV, the user may be kept away from the TV as much as possible by rotating and horizontal movement of the first bed board 11. By means of one driving assembly 5, rotating and deformation of a bed board of the electrically powered bed can be realized, and multiple bed boards are driven to move horizontally towards the first bed board 11 so as to adjust a position and a height of the human body, thereby realizing a lifting and lowering function of the electrically powered bed; and moreover, costs are saved, and a volume and weight of the electrically powered bed are reduced, which is convenient for transportation.

Further, the electrically powered bed further includes a second connecting-rod mechanism 6. The fourth bed board 14 is rotatably connected to the frame by the second connecting-rod mechanism 6, and the fourth bed board 14 is able to rotate relative to the third bed board 13 and the frame.

Two ends of the second connecting-rod mechanism 6 are respectively pivotably connected to the fourth bed board 14 and the frame 2. When the first bed board 11 rotates upwardly relative to the second bed board 12 and the frame 2, the first bed board 11 pulls the second bed board 12, the third bed board 13, and the fourth bed board 14 to move horizontally towards a position where the first bed board 11 is located and gradually move away from the fifth bed board 15. The fourth bed board 14 is limited by the second connecting-rod mechanism 6. A head portion of the fourth bed board 14 moves horizontally towards the first bed board 11, and a tail portion of the fourth bed board 14 rotates upwardly relative to the frame 2 with increasing of a horizontal movement distance of the head portion. With cooperation of the connecting-rod mechanism, one driving assembly 5 can drive two bed boards to rotate and deform, so that the effect of using a single motor to drive the electrically powered bed is further optimized.

Figure 4:
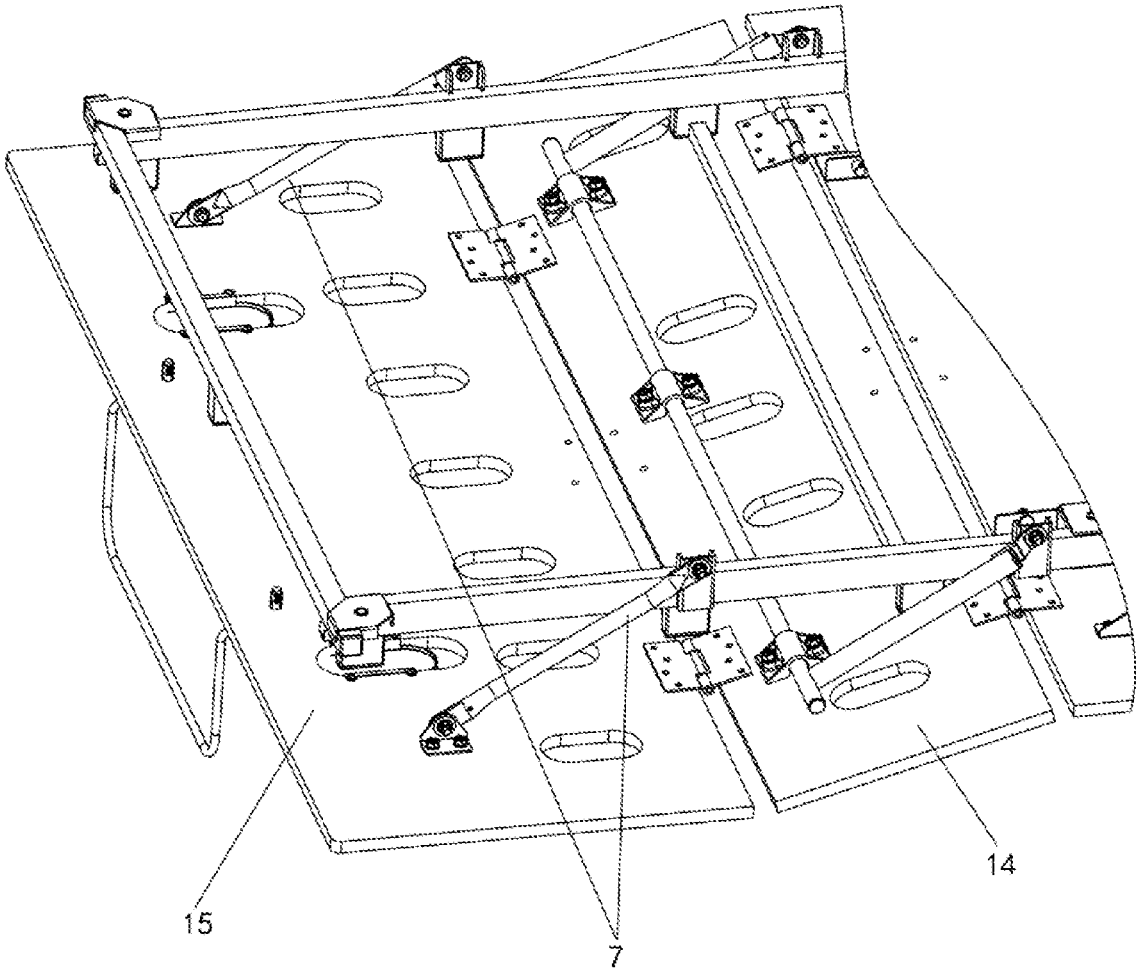
FIG. 4 schematically shows a partial enlarged view of a single-motor electrically powered bed according to an embodiment of the disclosure.

Referring to FIG. 4, the single-motor electrically powered bed further includes a third connecting-rod mechanism 7. The fifth bed board 15 is pivotably connected to the fourth bed board 14 according to the sequence, and the fifth bed board 15 is rotatably connected to the frame by the third connecting-rod mechanism 7.

When the fourth bed board 14 moves, a head portion of the fifth bed board 15, which is pivotably connected to the fourth bed board 14, rotates upwards with the tail portion of the fourth bed board 14 under a pulling force of the fourth bed board 14 and the action of the third connecting-rod mechanism 7. If a forearm portion of a person is located on the third bed board 13, a back portion leaning on the first bed board 11, a knee joint being located on a junction of the fourth bed board 14 and the bed board 15, when the first bed board 11 rotates upwards, changes of bed boards better adapt to a changing curve of the human body. This solution only uses one driving assembly 5 to realize a deformation function that is realized by using multiple motors in a conventional electrically powered bed, costs of electrically powered bed are saved.

Figure 3:
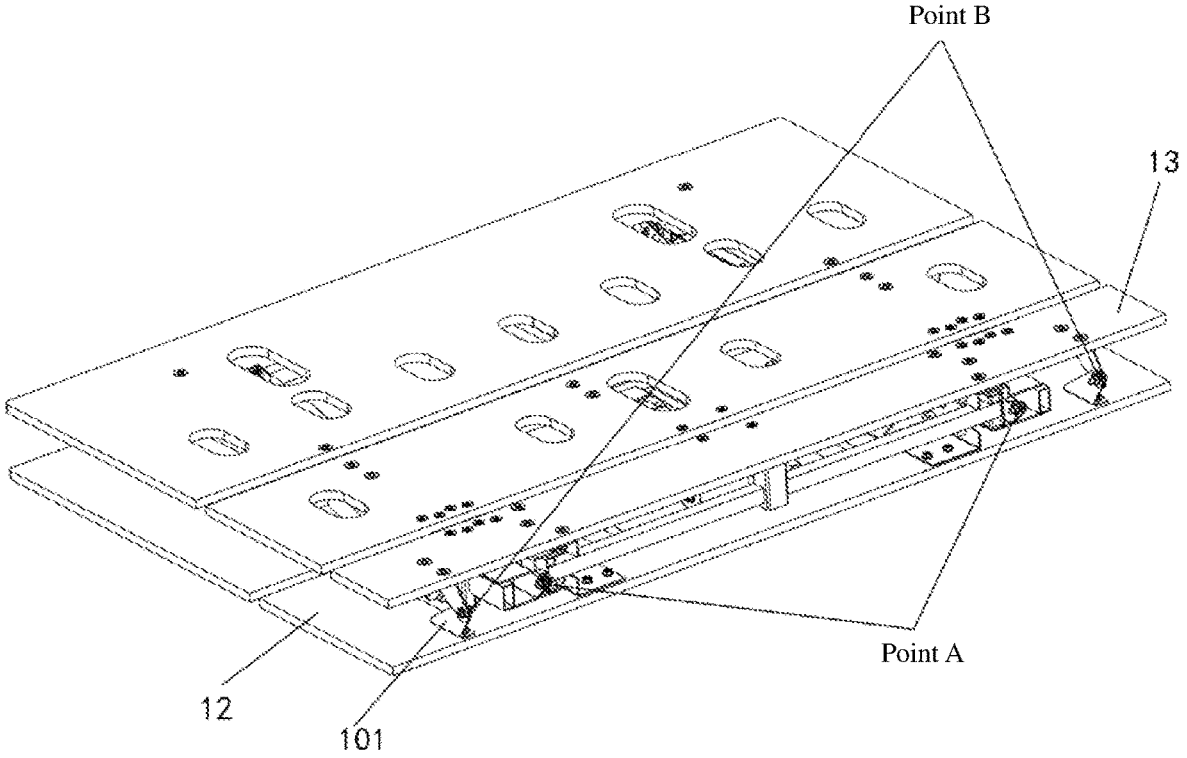
FIG. 3 schematically shows a single-motor electrically powered bed in a folded state according to an embodiment of the disclosure.

Referring to FIG. 2 and FIG. 3, the frame 2 further includes a front frame 21 and a rear frame 22. Herein, the front frame 21 and the rear frame 22 are pivotably connected to each other. The first bed board 11 and the second bed board 12 are disposed on a top of the front frame 21, and the third bed board 13, the fourth bed board 14, and the fifth bed board 15 are disposed on a top of the rear frame 22. The second bed board 12 and the third bed board 13 are pivotably connected to each other. An outer diameter of the front frame 21 is less than an inner diameter of the rear frame 22, and the sliding assembly 3 is disposed at an inner side of the front frame 21. When the first bed board 11 is in a horizontal position, a pivot between the front frame 21 and the rear frame 22 and a pivot between the second bed board 12 and the third bed board 13 are located at a same axis.

When the bed boards do not change, the pivot between the front frame 21 and the rear frame 22 and the pivot between the second bed board 12 and the third bed board 13 are located at the same axis. The first bed board 11 is located on the top of the front frame 21 and is far away from the rear frame, and the second bed board 12 is located on the top of the front frame 21 and is close to the rear frame. An edge of the second bed board 12, which is close to the rear frame 22, does not go beyond a pivot axis between the front frame 21 and the rear frame 22. An edge of the third bed board 13, which is close to the front frame 21, does not go beyond the pivot axis between the front frame 21 and the rear frame 22. The third bed board 13, the fourth bed board 14, and the fifth bed board 15 are successively pivotably connected and are located on the top of the rear frame 22. The front frame 21 and the rear frame 22 are folded in a thickness direction with the pivot axis serving as a rotation shaft, which realizes folding of the entire electrically powered bed, is helpful to reduce a packaging volume of a product, and is convenient for transportation and delivery into houses.

Preferably, the second bed board 12 and the third bed board 13 are hinged by a single-piece hinge base 101, which is convenient for mounting, is helpful to fold the front frame and the rear frame in the thickness direction, and is helpful to reduce a thickness of the folded electrically powered bed. The single-piece hinge base 101 is easy to mount, has low costs, and is convenient and quick to use.

Preferably, the outer diameter of the front frame 21 is less than the inner diameter of the rear frame 22, or an inner diameter of the front frame 21 is larger than an outer diameter of the rear frame 22. When the outer diameter of the front frame 21 is less than the inner diameter of the rear frame 22, the front frame 21 may be folded into the rear frame 22 when the front frame 21 and the rear frame 22 are folded. After the front frame 21 and the rear frame 22 are folded fully in the thickness direction, the thickness of the folded electrically powered bed is further reduced.

Further, the driving assembly 5 includes a driving means 51, a first holder 52, and a second holder 53. Herein, one end of the second holder 53 is fixed on a position in the middle of an edge of the first bed board 11, which is close to the second bed board 12, and the other end of the second holder 53 is pivotably connected to one end of the driving means 51 and is in fixed connection with one end of the first holder 52. The other end of the driving means 51 is connected to an edge of the front frame 21, which is close to the rear frame. The other end of the first holder 52 is in fixed connection with the first bed board 11. The driving means 51 moves in a straight line horizontally to drive the first bed board 11 to rotate relative to the second bed board 12 and the front frame 21.

The second holder 53 is fixed to the edge of the first bed board 11, which is close to the rear frame. An extending direction of the second holder 53 is perpendicular to an extending direction of the first bed board 11. It is preferable that the second holder 53 is located at the middle of the edge. The second holder 53 cooperates with the driving means 51 and the first holder 52, so that the first bed board 11 may be directly lifted or lowered. Since a moving direction of the driving means 51 is parallel to the frame, a structure of the electrically powered bed is more compact, which is helpful to fully fold a bed body and reduce the thickness of the folded electrically powered bed.

Preferably, the driving means 51 is a straight-rod motor.

Further, the sliding assembly 3 includes a guiding rail 31, a pulley 32, and a sliding frame 33. Herein, the guiding rail 31 is fixed on an inner side of the front frame 21. The pulley 32 is pivotably connected to the sliding frame 33, and is able to slide in the guiding rail 31. The sliding frame 33 is fixed on a bottom surface of the second bed board 12.

Such a sliding assembly 3 is easy to mount and has low costs. If the guiding rail 31 and the front frame 21 are designed integrally, the volume and mass of the product can be further reduced, and costs can be saved.

Further, the single-motor electrically powered bed further includes a reinforcing plate 8 and a connecting plate 9. Herein, the reinforcing plate 8 is fixed on a bottom surface of the third bed board 13. An extending direction of the reinforcing plate 8 and an extending direction of the sliding frame 33 are located in a same straight line. The reinforcing plate 8 and the sliding frame 33 are in removable fixed connection by the connecting plate 9.

When the electrically powered bed is used, the removable connecting plate 9 is mounted to reinforce connection strength between bed boards. When the electrically powered bed is not used, the connecting plate 9 can be removed directly, so that the connecting plate 9 does not affect folding of the electrically powered bed.

Further, the front frame 21 is provided, at one end which is far away from the rear frame 22, with bed leg mounting holes 10 disposed symmetrically. The rear frame 22 is provided, at each corner, with a bed leg mounting hole 10.

When bed legs are directly mounted in the bed leg mounting holes 10 of the front frame 21 and the rear frame 22, the electrically powered bed can be used, which is convenient and quick.

After considering the description and practicing the invention disclosed herein, those skilled in the art can easily conceive of other embodiments of the disclosure. The application intends to cover any variations, uses or adaptive changes of the disclosure, and these variations, uses or adaptive changes follow general principles of the disclosure and includes common knowledge or conventional technical means in the art not disclosed in the disclosure. It is deemed that the description and the embodiments are only exemplary, and the actual scope and spirit of the disclosure are defined by the following claims.

It should be understood that, the disclosure is not limited to the precise structure that has been described above and illustrated in the drawings, and various modifications and changes can be made without departing from the scope of the disclosure.

The invention claimed is:

1. A single-motor electrically powered bed, comprising: a bed board, a frame, a sliding assembly, a first connecting-rod mechanism, and a driving assembly, wherein the bed board comprises a first bed board, a second bed board, a third bed board, a fourth bed board, and a fifth bed board, wherein the first bed board, the second bed board, the third bed board, the fourth bed board and the fifth bed board are successively and horizontally arranged on a top of the frame, and the first bed board, the second bed board, the third bed board, and the fourth bed board are successively pivotably connected to one another at junctions;

the first bed board is rotatably connected to the frame by the first connecting-rod mechanism, and is rotatable relative to the second bed board and the frame, driven by the driving assembly; and the second bed board is slidable horizontally relative to the frame by the sliding assembly, with rotating movement of the first bed board and driving the third bed board and the fourth bed board to move horizontally;

wherein the frame further comprises a front frame and a rear frame, wherein the front frame and the rear frame are pivotably connected to each other; the first bed board and the second bed board are disposed on a top of the front frame, and the third bed board, the fourth bed board, and the fifth bed board are disposed on a top of the rear frame; the second bed board and the third bed board are pivotably connected to each other;

an outer diameter of the front frame is less than an inner diameter of the rear frame, and the sliding assembly is disposed at an inner side of the front frame; and in response to the first bed board being in a horizontal position, a pivot between the front frame and the rear frame and a pivot at the junction between the second bed board and the third bed board are located at a same axis;

wherein the driving assembly comprises a driving means, a first holder, and a second holder, wherein one end of the second holder is fixed on a position in a middle of an edge of the first bed board, the edge of the first bed board is adjacent to the second bed board, and another end of the second holder is pivotably connected to one end of the driving means and is in fixed connection with one end of the first holder; another end of the driving means is connected to an edge of the front frame, the edge of the front frame is adjacent to the rear frame; another end of the first holder is in fixed connection with the first bed board; and the driving means moves in a straight line horizontally to drive the first bed board to rotate relative to the second bed board and the front frame.

2. The single-motor electrically powered bed according to claim 1, wherein the single-motor electrically powered bed further comprises a second connecting-rod mechanism, wherein the fourth bed board is rotatably connected to the frame by the second connecting-rod mechanism, and is rotatable relative to the third bed board and the frame.

3. The single-motor electrically powered bed according to claim 2, wherein the single-motor electrically powered bed further comprises a third connecting-rod mechanism, wherein the fifth bed board is pivotably connected to the fourth bed board, and the fifth bed board is rotatably connected to the frame by the third connecting-rod mechanism.

4. The single-motor electrically powered bed according to claim 1, wherein the sliding assembly comprises a guiding rail, a pulley, and a sliding frame, wherein, the guiding rail is fixed on an inner side of the front frame; the pulley is pivotably connected to the sliding frame, and is slidable in the guiding rail; and the sliding frame is fixed on a bottom surface of the second bed board.

5. The single-motor electrically powered bed according to claim 4, wherein the single-motor electrically powered bed further comprises a reinforcing plate and a connecting plate, wherein the reinforcing plate is fixed on a bottom surface of the third bed board; an extending direction of the reinforcing plate and an extending direction of the sliding frame are located in a same straight line; and the reinforcing plate and the sliding frame are in removable fixed connection by the connecting plate.

6. The single-motor electrically powered bed according to claim 5, wherein the front frame is provided, at one end which is distal from the rear frame, with bed leg mounting holes disposed symmetrically, and the rear frame is provided, at each corner, with a bed leg mounting hole.

7. The single-motor electrically powered bed according to claim 6, wherein the second bed board and the third bed board are connected by a single-piece hinge base.

* * * * *